US006779496B2

(12) United States Patent
Gaessler et al.

(10) Patent No.: US 6,779,496 B2
(45) Date of Patent: Aug. 24, 2004

(54) PRESSURE RESERVOIR FOR EXERTING PRESSURE ON A HYDRAULIC SYSTEM, WITH WHICH PREFERABLY A GAS EXCHANGE VALVE OF AN INTERNAL COMBUSTION ENGINE IS ACTUATED

(75) Inventors: Hermann Gaessler, Vaihingen (DE); Udo Diehl, Stuttgart (DE); Karsten Mischker, Leonberg (DE); Rainer Walter, Pleidelsheim (DE); Juergen Schiemann, Markgroeningen (DE); Christian Grosse, Kornwestheim (DE); Volker Beuche, Stuttgart (DE); Stefan Reimer, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/221,722

(22) PCT Filed: Jan. 12, 2002

(86) PCT No.: PCT/DE02/00079

§ 371 (c)(1),
(2), (4) Date: Apr. 18, 2003

(87) PCT Pub. No.: WO02/055847

PCT Pub. Date: Jul. 18, 2002

(65) Prior Publication Data

US 2003/0172885 A1 Sep. 18, 2003

(30) Foreign Application Priority Data

Jan. 16, 2001 (DE) ..... 1 0101 584

(51) Int. Cl.[7] ..... F01L 9/02

(52) U.S. Cl. ..... 123/90.14; 123/90.12; 123/90.24; 123/90.66; 123/198 C; 251/43; 251/44; 251/53; 137/565.11; 137/565.18; 137/565.34

(58) Field of Search ..... 123/90.12, 90.14, 123/90.24, 90.66, 198 C; 251/43–45, 53; 137/14, 565.11, 565.13, 565.18, 565.19, 565.34; 417/311, 540; 267/126

(56) References Cited

U.S. PATENT DOCUMENTS

| | | | | |
|---|---|---|---|---|
| 3,905,459 A | * | 9/1975 | Liebich | 192/109 F |
| 4,246,924 A | * | 1/1981 | Droitsch et al. | 137/115.18 |
| 4,540,848 A | * | 9/1985 | Beijar et al. | 174/152 R |
| 5,694,893 A | | 12/1997 | Kaufman et al. | 123/90.12 |
| 5,984,835 A | * | 11/1999 | Kawa et al. | 477/150 |
| 6,321,703 B1 | * | 11/2001 | Diehl et al. | 123/90.12 |

FOREIGN PATENT DOCUMENTS

| | | |
|---|---|---|
| DE | 198 26 047 A | 12/1999 |
| EP | 0 774 601 A | 5/1997 |

* cited by examiner

*Primary Examiner*—Thomas Denion
*Assistant Examiner*—Kyle Riddle
(74) *Attorney, Agent, or Firm*—Ronald E. Greigg

(57) ABSTRACT

A pressure reservoir is used to exert pressure on a hydraulic system with which, a gas exchange valve, for instance, of an internal combustion engine can be actuated. The pressure reservoir includes a housing and a piston that is prestressed in operation by a device. To enable making the pressure reservoir as small as possible, it is proposed that the device which prestresses the piston of the pressure reservoir has a characteristic force-travel curve, in one range of motion of the piston, that has a slope which differs from the slope in a different range of motion of the piston.

9 Claims, 3 Drawing Sheets

PRESSURE RESERVOIR FOR EXERTING PRESSURE ON A HYDRAULIC SYSTEM, WITH WHICH PREFERABLY A GAS EXCHANGE VALVE OF AN INTERNAL COMBUSTION ENGINE IS ACTUATED

CROSS-REFERENCE TO RELATED APPLICATIONS

This application is a 35 USC 371 application of PCT/DE 02/00079, filed on Jan. 12, 2002.

BACKGROUND OF THE INVENTION

1. Field of the Invention

The present invention relates to a pressure reservoir for exerting pressure on a hydraulic system, with which preferably a gas exchange valve of an internal combustion engine is actuated, having a housing and a piston prestressed in operation by a device.

2. Description of the Prior Art

A hydraulic system with a pressure reservoir of the type with which this invention is concerned is known from German Patent Disclosure DE 193 26 047 A1. A hydraulic system of this kind is used for instance for actuating the inlet and outlet valves of an internal combustion engine, if the engine does not have a camshaft. Such an engine has the advantage that the control times of the inlet and outlet valves are independent of the position of the piston of the applicable cylinder. Depending on the engine operating state, such as high rpm, and on the torque desired by the driver, valve opening and closing times can be achieved which make especially optimal engine operation possible in terms of emissions and fuel consumption.

The known hydraulic system functions with a hydraulic circuit, which is supplied from a hydraulic reservoir via a high-pressure hydraulic pump. An actuating device includes a piston that can be acted upon hydraulically in both directions of motion and that is connected to the valve shaft of a gas exchange valve, such as an inlet valve. Via 2/2-way valves, one at a time of the two chambers of the hydraulic cylinder can be subjected to higher pressure, which leads to a corresponding motion of the piston and as a result to an opening or closing event of the gas exchange valve of the engine block.

The hydraulic circuit communicates with a hydraulic pressure reservoir, which is embodied as a spring-loaded piston reservoir and serves to damp vibration in the hydraulic system. An identically embodied emergency pressure reservoir also communicates with one of the two chambers in the hydraulic cylinder; if the pressure drops in the hydraulic line, this emergency pressure reservoir still furnishes sufficient pressure and a sufficient fluid volume to enable the gas exchange valve to be moved to its closed position of repose. The two pressure reservoirs operate at different pressure levels, which are set by means of different stiffnesses of the corresponding restoring springs. From DE 198 26 047 A1, it is also known to use only a single pressure reservoir, which functions simultaneously as both a working pressure reservoir and an emergency pressure reservoir.

If only a single pressure reservoir is provided, its design must be such that at minimal operating pressure in the hydraulic system, sufficient hydraulic medium is stored to enable reliably moving the gas exchange valve into the closed position of repose in the event of an emergency. This requires a relatively soft spring and a long spring travel. In order at the same time to assure that over the entire operating pressure range, a sufficient damping action exists, this kind of pressure reservoir, equipped with a soft spring, must be very long structurally, as a function of the minimum and maximum operating pressure. Such a large pressure reservoir, however, can be accommodated only with difficulty in the available installation space in an internal combustion engine. Moreover, because of the great structural length, in the operating pressure range a relatively large volume of fluid must be stored in such a pressure reservoir, and as an idle volume, beyond the desired damping action, this adversely affects the dynamics of the hydraulic system.

It is therefore the object of the present invention to refine a pressure reservoir of the type defined at the outset such that on the one hand, a pressure damping function and on the other an emergency pressure function are available, while nevertheless the pressure reservoir is as small as possible.

The above and other objects and advantages are attained, in a pressure reservoir of the type defined at the outset, by providing that the device which prestresses the piston of the pressure reservoir has a characteristic force-travel curve, in one range of motion of the piston, that has a slope which differs from the slope in a different range of motion of the piston.

According to the invention, a prestressing device with a nonlinear characteristic is used in the pressure reservoir. It is understood then that first, when the piston is urged out of its pressureless position of repose, a softer characteristic of the prestressing device is desired; that is, a change in pressure results in a relatively long movement distance of the piston. In a range of motion of the piston that is far away from the position of repose of the piston, conversely, a stiffer characteristic of the prestressing device of the piston is desired; that is, a pressure change should cause only a comparatively slight motion of the piston.

In this way, both desired functions, namely the emergency pressure function and the vibration damping function, can be achieved in a single pressure reservoir: The emergency pressure function is available in the range of motion of the piston of the pressure reservoir in which the prestressing device has a relatively soft characteristic. Within this piston range of motion, the pressure reservoir is thus already capable, at only a slight pressure drop, of dispensing a large enough fluid volume into the hydraulic circuit for securing, for instance a gas exchange valve, in the event of a pressure loss. The vibration damping function exists in the range of motion of the piston within which the characteristic force-travel curve is comparatively steep. In this piston range of motion, even major pressure fluctuations result in only a slight piston motion. Accordingly, in this piston range of motion, it is also possible for only a slight movement distance of the prestressing device to be provided, which in turn is favorable for the sake of a short structural length of the pressure reservoir.

The pressure reservoir of the invention can accordingly be used on the one hand for storing a fluid volume for emergency operation, and on the other, it can be used in normal operation for vibration damping, and at the same time is very small in size. It can therefore be integrated easily and without problems into the available installation space. Furthermore, because of the slight fluid volume stored and the great stiffness of the prestressing device, an optimal vibration damping can be achieved in normal operation without impairing the system dynamics.

In a first refinement, the device which prestresses the piston of the pressure reservoir has at least two series-connected devices, with characteristic force-travel curves of different slope, which prestress the piston in operation. The desired properties of such a pressure reservoir can be achieved especially easily, since in it, the various functions are also performed physically separately.

It is especially preferred that the devices for prestressing the piston include at least two series-connected springs, and the stiffness of one spring differs from that of the other spring. A pressure reservoir with this kind of two-stage spring assembly can be constructed simply and very economically and furthermore is robust.

In an especially preferred feature of the pressure reservoir of the invention, the pressure reservoir has an elongated part with two end portions and one support portion, which is disposed between the end portions and has a larger outer dimension than the end portions and on which two adjacent springs are braced, the one spring being tightened in operation between one side of the support portion and the piston, and the other spring being tightened between the other side of the support portion and a housing portion. An elongated part of this kind enables the secure guidance of the piston, on the one hand, and of the corresponding springs, on the other.

It is also provided that at least two stops are provided, which prevent the springs from being tightened into a block in operation. Essentially, tightening springs into a block has two disadvantages: First, most springs, in the range of motion located just before tightening into a block occurs, exhibit a markedly nonlinear, and above all often non-replicable, characteristic curve behavior. This is unwanted in the present case as well. Furthermore, whenever the springs are tightened into a block, wear of the touching surfaces of the springs can occur, which can impair the service life of the springs. The stops according to the invention prevent this.

Especially simply, such stops can be realized in conjunction with the above-described elongated part: In this case, the length of the elongated part can be adapted such that one axial end of the elongated part forms a stop with a housing portion of the pressure reservoir, and the other axial end of the elongated part forms a stop with the piston.

Basically, all types of springs are suitable for the pressure reservoir of the invention. Examples are spiral springs, air springs and magnet springs. It is especially preferred, however, that at least one of the springs is a cup spring. The use of cup springs, because of the better ratio between the spring work and the installation space, brings about a further reduction in the structural length of the pressure reservoir. Moreover, because of the strong friction damping in a cup spring assembly, the damping action of the reservoir is enhanced.

The invention also relates to a hydraulic system for actuating a gas exchange valve of an internal combustion engine, in particular of a motor vehicle, having a fluid reservoir, a fluid pump, a fluid line, a pressure reservoir that communicates with the fluid line having a housing and a piston prestressed in operation by a device, and having an actuating device, which communicates via a valve device with the fluid line and actuates the gas exchange valve.

To reduce the overall dimensions of the hydraulic system, it is proposed that the pressure reservoir be embodied as described above.

BRIEF DESCRIPTION OF THE DRAWINGS

Below, exemplary embodiments of the invention are described in detail, in conjunction with the accompanying drawings, in which.

DESCRIPTION OF THE PREFERRED EMBODIMENTS

Figure 1:
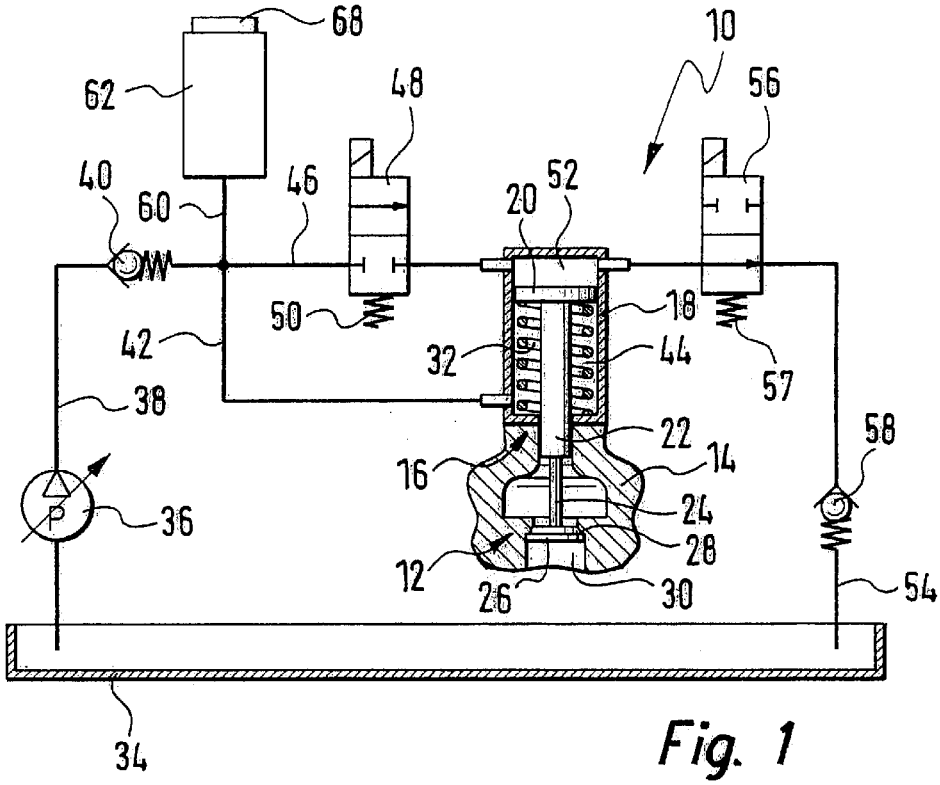
FIG. 1, a basic illustration of a hydraulic system for actuating a gas exchange valve of an internal combustion engine.

In FIG. 1, a hydraulic system referred to overall by reference numeral 10 serves to actuate a gas exchange valve, which here is embodied as an inlet valve 12 of an internal combustion engine 14.

The inlet valve 12 is actuated by a hydraulic cylinder 16. This cylinder includes a housing 18, in which a piston 20 with a piston rod 22 is guided slidingly. The piston rod 22 is passed through the housing 18 and is connected to a valve shaft 24, which in turn is formed onto a platelike valve element 26. In the closed state of the inlet valve 12, the valve element 26 rests tightly against a valve seat 28 in the upper region of a combustion chamber 30 of the engine 14. If no hydraulic pressure is available, the piston 20 is pressed upward by a spring 32, and as a result the inlet valve 12 is closed.

The hydraulic system 10 further includes a supply container 34, from which hydraulic fluid is pumped by a high-pressure pump 36 into a high-pressure hydraulic line 38. Downstream of a check valve 40, the high-pressure hydraulic line 38 branches off into one branch 42, which discharges directly into a lower work chamber 44 of the hydraulic cylinder 16. Another branch 46 of the high-pressure hydraulic line 38 leads to a 2/2-way switching valve 48, which in the currentless state is pressed into its closed position by a spring 50. The branch 46 of the high-pressure hydraulic line 38 leads, downstream of the 2/2-way switching valve 48, to an upper work chamber 52 of the hydraulic cylinder 16. From there, a high-pressure hydraulic line leads, via a further 2/2-way switching valve 56 and a check valve 58, back to the supply container 34. The 2/2-way switching valve 56 is opened by a spring 57, in the currentless state.

A tie line 60, which communicates with a pressure reservoir 62, discharges at the point where the high-pressure hydraulic line 38 branches off into the branch 42 and the branch 46. The construction of the pressure reservoir is shown in detail in FIG. 2.

The pressure reservoir 62 includes a housing 64, which has an overall cylindrical shape, and in which a cylindrical hollow chamber 66 is embodied. On the right-hand side, in FIG. 2, the hollow chamber 66 is closed with a cap 68, while conversely, on the left-hand side in FIG. 2, it communicates with the tie line 60 via a connecting conduit 70. The cap 68 has a valve opening, which in the present exemplary embodiment is located outside the sectional plane and is therefore not visible.

A piston 72 is retained displaceably in the hollow chamber 66. The radial jacket face of the piston 72 is sealed off from the inner wall of the hollow chamber 66 by a sealing ring 74, which is placed in an annular groove 76 in the outer jacket face of the piston 72. A piston rod 78 is formed onto the piston 72. It extends from the piston 72 toward the cap 68. The piston 72 and the piston rod 78 are coaxial to the hollow chamber 66 of the housing 64 of the pressure reservoir 62.

Coaxially to the piston 72 and to the piston rod 78, there is an elongated tubular part 80 located in the hollow chamber 66 of the pressure reservoir 62. The elongated tubular part 80 is slipped onto the piston rod 78 in sliding communication. The elongated tubular part 80 includes a cylindrical end portion 82, located on its left-hand side in terms of FIG. 2, and a cylindrical end portion 84, located on its right-hand side in FIG. 2. Located between the two end portions 82 and 84 is a support portion 86, whose outside diameter is greater than the outside diameter of the left-hand end portion 82 and of the right-hand end portion 84. In other words, the support portion 86 takes the form of an annular collar.

Between the support portion 86 and the piston 72, a packet 87 of a total of twelve cup springs 88 (for the sake of simplicity, not all the cup springs 88 have reference numerals in the drawing) is disposed coaxially to the piston 72, piston rod 78, and elongated tubular part 80. The packet 87 is divided into four individual groups (not carrying reference numerals), each comprising three parallel cup springs 88. A packet 89 comprising three parallel cup springs 90 is disposed between the support portion 86 and the cap 68 of the housing 64.

Figure 2:
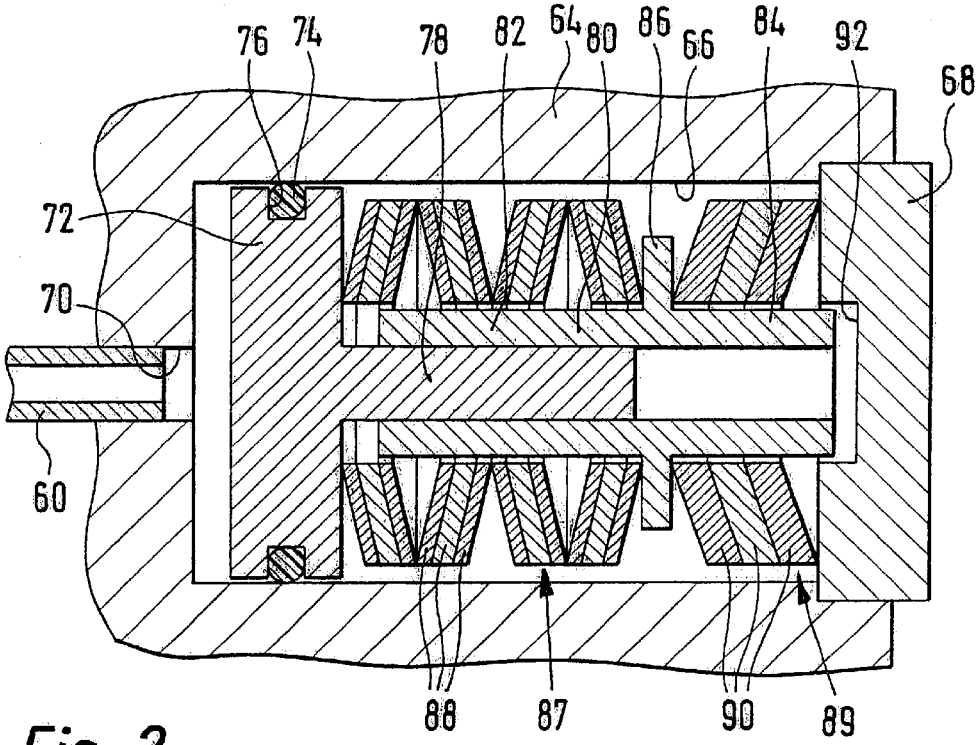
FIG. 2, a section through a first exemplary embodiment of a pressure reservoir of the hydraulic system of FIG. 1.

In the pressureless state of repose, shown in FIG. 2, of the pressure reservoir 62, the cup springs 88 and 90 are relaxed. In this state, there is a free space between the axial end, on the left in FIG. 2, of the elongated tubular part 80 and the piston 72. A free space is also present between the right-hand axial end, in the drawing, of the elongated tubular part 80 and the bottom of a recess 92 in the cap 68 of the housing 64. The cup springs 88 are all softer than the cup springs 90. The spring travel of the packet formed of the cup springs 88 is overall longer than the spring travel of the group formed by the cup springs 90.

The hydraulic system 10 shown in FIG. 1, having the pressure reservoir 62 shown in FIG. 2, functions as follows:

The high-pressure pump 36 pumps hydraulic fluid out of the supply container 34 into the hydraulic line 38 and from there via the branch line 42 into the lower work chamber 44 of the hydraulic cylinder 16. When the switching valve 48 is opened and the switching valve 56 is closed, the upper work chamber 52 of the hydraulic cylinder 16 is also put under pressure by hydraulic fluid. Since the engagement area in the axial direction on the top side of the piston 20 of the hydraulic cylinder 16 is greater than on its underside, the piston 20 is pressed downward in this case, and the inlet valve 12 is opened.

If the switching valve 48 is closed and the switching valve 56 is opened, the upper work chamber 52 is made to communicate, via the branch line 54, with the ambient pressure, and as a result the piston 20 is moved upward again, and the inlet valve 12 is closed. In this way, without having to trigger the inlet valve 12 mechanically, for instance by means of a camshaft of the engine 14, very fast opening and closing times of the inlet valve 12 can be attained.

Figure 3:
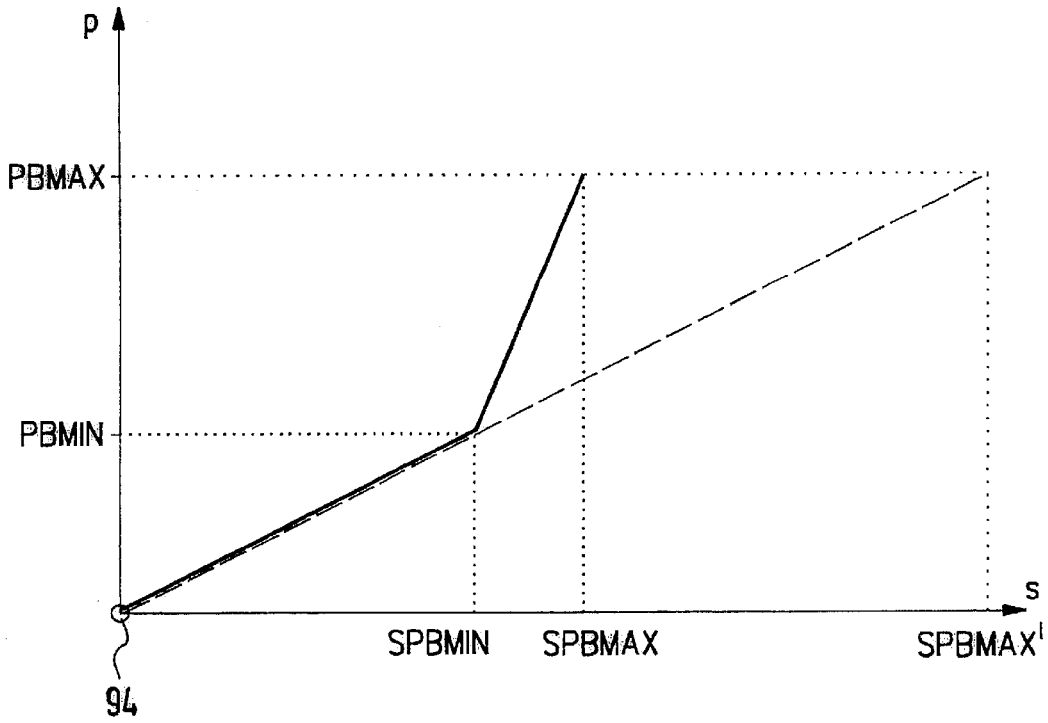
FIG. 3, a pressure and travel graph to explain the function of the pressure reservoir of FIG. 2.

If the high-pressure pump 36 is not pumping, and in other words the hydraulic line 38 and the tie line 60 are pressureless, then the piston 72 of the pressure reservoir 62 is in the position of repose shown in FIG. 2. In the graph of FIG. 3, in which the travel s of the piston 72 of the pressure reservoir 62 is plotted over the hydraulic pressure p, this position of repose is at a position identified by reference numeral 94.

If the high-pressure pump 36 is switched on, the pressure in the hydraulic line 38 and the tie line 60 rises. Since the cup springs 88 have a lesser stiffness than the cup springs 90, the elongated tubular part 80 initially remains stationary during this pressure increase, while conversely the piston 72 moves in the direction of the cap 68 of the housing 64 and in the process compresses the cup springs 88.

The spacing between the left-hand axial end, in terms of FIG. 2, of the elongated tubular part 80 and the piston 72 is selected such that the piston 72 comes to rest on the elongated tubular part 80 whenever the minimum operating pressure PBMIN is reached. The corresponding travel accomplished by the piston 72 is shown in FIG. 3 as SPBMIN. The geometry inside the pressure reservoir 62, and in particular the length of the left-hand end portion 82 of the elongated tubular part 80, is selected such that whenever the piston 72 comes to rest on the elongated tubular part 80, the cup springs 88 have not yet moved into a block.

If the pressure is increased further, then the elongated tubular part 80 is moved by the piston 72 in the direction of the bottom of the recess 92 in the cap 68 of the housing 64. As a result, the cup springs 90 are deformed. Since the cup springs 90 are considerably stiffer than the cup springs 88, in this range a markedly greater slope of the curve shown in FIG. 3 results. The spacing between the right-hand axial end, in terms of FIG. 2, of the elongated tubular part 80 and the bottom of the recess 92 in the cap 68 is selected such that whenever the hydraulic pressure reaches the maximum operating pressure PBMAX, the elongated tubular part 80 comes to rest on the bottom of the recess 92 in the cap 68. The length of the right-hand end portion 84 of the elongated tubular part 80, in turn, is selected such that whenever the elongated tubular part 80 touches the cap 68, the springs 90 of the group 89 have not yet been completely deformed. The piston 72 in this case has covered the maximum possible travel SPBMAX.

When the hydraulic system 10 is in its normal operating state, the hydraulic pressure in the hydraulic lines 38, 42, 46 and 60 is in the range between the minimum operating pressure PBMIN and the maximum operating pressure PBMAX. In this case, the pressure reservoir 62 functions as a vibration damper for pressure fluctuations that occur in the hydraulic fluid of the hydraulic system 10. Because of the great stiffness of the cup springs 90, even major amplitudes of the pressure vibrations cause only a slight motion of the piston 72. The length of the packet 89 of cup springs 90 can therefore be slight, which in turn reduces the total structural length of the pressure reservoir 62.

The great stiffness of the cup springs 90 also makes it possible to reduce the fluid volume stored in the pressure reservoir 62. This makes the desired vibration damping in the operating pressure range possible, without impairment of the system dynamics of the hydraulic system 10. Moreover, the use of the cup springs 90 improves the damping action of the pressure reservoir 62, since major friction damping occurs between the individual cup springs 90.

Compared to a conventional pressure reservoir, the pressure reservoir 62 shown in FIG. 2 is very small in size. If vibration damping in the same operating pressure range is to be furnished in a conventional pressure reservoir, the conventional pressure reservoir would have to have a markedly longer spring travel and thus a markedly greater structural length. This is represented by dashed lines in FIG. 3. The spring travel required in a conventional pressure reservoir for the same operating pressure range and the same emergency pressure properties is marked SPMAX' in FIG. 3. The reduction in structural length for the pressure reservoir 62 compared with a conventional pressure reservoir thus amounts to the difference between SPMAX' and SPMAX.

Upon a pressure drop inside the hydraulic system 10, for caused by a failure of the high-pressure pump 36, assurance must be provided that the piston 20 of the hydraulic cylinder 16 can still be moved far enough upward that the inlet valve 12 can be closed. This is necessary to prevent the valve element 26 of the inlet valve 12, which element protrudes into the combustion chamber 30, from colliding with other valve elements or even with the piston (not shown) in the combustion chamber 30.

In such a case, the cup springs 90 and especially the cup springs 88 press the piston 72 in the pressure reservoir 62 back into its extreme left-hand position in FIG. 2. Correspondingly, a hydraulic fluid volume is forced out of the pressure reservoir 62 into the tie line 60 and from there via the branch line 42 into the lower work chamber 44 of the hydraulic cylinder 16. The spring travel of the cup springs 88 and the resultant movement distance SPMIN of the piston 72 is selected such that secure closure of the inlet valve 12 is possible in every situation. Thus in the normal operating range, a pressure reservoir 62 with optimal damping properties is available, while conversely, in the event of a pressure drop, the same pressure reservoir 62 furnishes a sufficient hydraulic fluid volume for secure closure of the inlet valve 12 via the hydraulic cylinder 16.

In FIGS. 4–7, further exemplary embodiments of pressure reservoirs 62 are shown schematically. Elements whose function is equivalent to those shown in FIG. 2 are identified by the same reference numerals. They will not be described again in detail.

Figure 4:
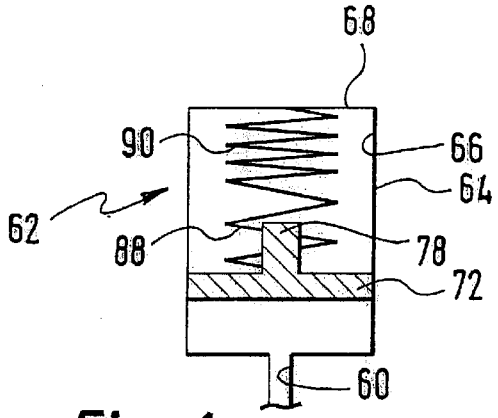
FIG. 4, a schematic section through a second exemplary embodiment of a pressure reservoir.

In the exemplary embodiment shown in FIG. 4, an elongated tubular part 80 is omitted. Instead, the springs 88 and 90, shown only symbolically, of different stiffness and different length are integrally joined together.

Figure 5:
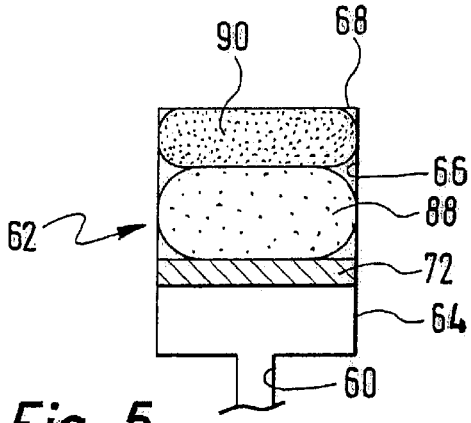
FIG. 5, a schematic section through a third exemplary embodiment of a pressure reservoir.

In the exemplary embodiment shown in FIG. 5, instead of cup springs or helical springs, air springs 88 and 90 are used, which have different volumes and different fill pressures.

Figure 6:
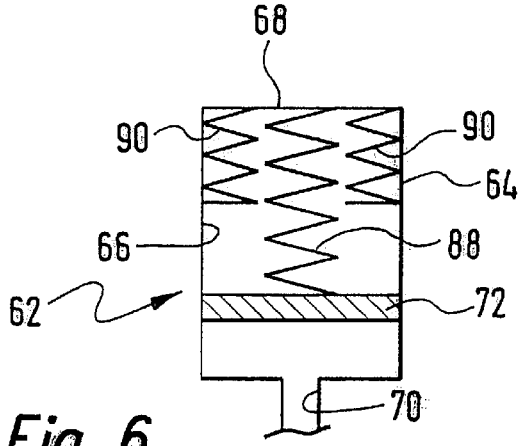
FIG. 6, a schematic section through a fourth exemplary embodiment of a pressure reservoir.

In FIG. 6, springs of equal stiffness are used, but these are springs disposed parallel, with different lengths. The spring 88 disposed centrally in FIG. 6 has a greater length than the two springs 90 disposed laterally of the spring 88. In this way, in a first range of motion of the piston 72, located adjacent to the position repose, only the spring 88 is initially acted upon, while conversely in a second range of motion of the piston 72, the springs 90 are acted upon as well, as a result of which the total spring stiffness increases.

Figure 7:
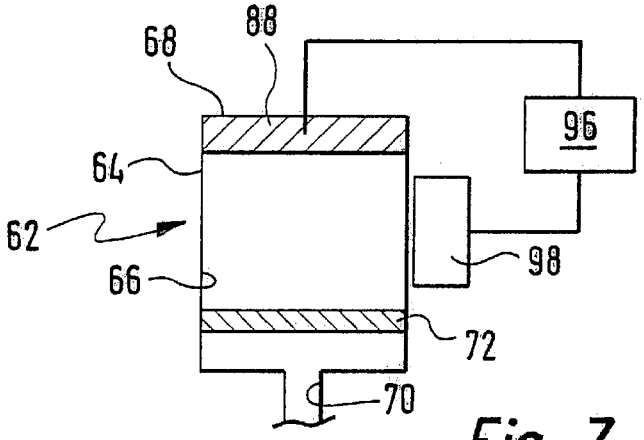
FIG. 7, a schematic section through a fifth exemplary embodiment of a pressure reservoir.

In FIG. 7, instead of springs, an electromagnet 88 is used, which exerts a repellent force on the piston 72 made of a permanent magnetic material. The repellent force can be adjusted by means of a controller 96 as a function of the position of the piston 72, which position is detected by a sensor 98.

The foregoing relates to preferred exemplary embodiments of the invention, it being understood that other variants and embodiments thereof are possible within the spirit and scope of the invention, the latter being defined by the appended claims.

We claim:

1. A pressure reservoir (62) for exerting pressure on a hydraulic system (10), the pressure reservoir comprising, a housing (64, 68)

a piston (72), and prestressing means (88, 90), prestressing the piston (72) of the pressure reservoir (62) during operation, the prestressing means having a characteristic force-travel curve, in one range of motion of the piston (72), that has a slope which differs from the slope in a different range of motion of the piston (72), said prestressing means (88, 90) having at least two series-connected devices (88, 90), which have characteristic force-travel curves of different slope and which prestress the piston (72) in operation, said at least two series-connected devices (88, 90) comprising at least two series-connected springs and where the stiffness of at least one spring (88) differs from that of at least one other spring (90), wherein the pressure reservoir (62) further comprises an elongated part (80) with two end portions (82, 84) and one support portion (86), which is disposed between the end portions (82, 84) and has a larger outer dimension than the end portions (82, 84) and on which two adjacent springs (88, 90) are braced, the at least one spring (88) being tightened in operation between one side of the support portion (86) and the piston (72), and the at least one other spring (90) being tightened between the other side of the support portion (86) and a housing portion (68).

2. The pressure reservoir (62) of claim 1 further comprising at least two stops, which stops prevent the springs (88, 90) from being tightened into a block in operation.

3. The pressure reservoir of claim 1 wherein the length of the elongated part (80) is adapted such that one axial end of the elongated part (80) forms a stop with a housing portion (68) of the pressure reservoir (62), and the other axial end of the elongated part (80) forms a stop with the piston (72).

4. The pressure of claim 1 the length of the elongated part (80) is adapted such that one axial end of the elongated part (80) forms a stop with a housing portion (68) of the pressure reservoir (62), and the other axial end of the elongated part (80) forms a stop with the piston (72).

5. The pressure reservoir of claim 1 wherein at least one of the springs (88, 90) is a cup spring.

6. The pressure reservoir of claim 3 wherein at least one of the springs (88, 90) is a cup spring.

7. A hydraulic system (10) for actuating a gas exchange valve (12) of an internal combustion engine (14), the system including a fluid reservoir (34), a fluid pump (36), a fluid line (38, 42, 44, 54, 60), a pressure reservoir (62) that communicates with the fluid line (38, 42, 44, 54, 60) and has a housing (64, 68) and a piston (72) prestressed in operation by prestressing means (88, 90), and an actuating device (16), which communicates via a valve device (48, 56) with the fluid line (38, 42, 44, 54, 60) and actuates the gas exchange valve (12), the prestressing means (88, 90) having a characteristic force-travel curve, in one range of motion of the piston (72), that has a slope which differs from the slope in a different range of motion of the piston (72), and including at least two series-connected springs (88, 90), the stiffness of at least one spring (88) differing from that of at least one other spring (90), wherein the pressure reservoir (62) further comprises an elongated part (80) with two end portions (82, 84) and one support portion (86), which is disposed between the end portions (82, 84) and has a larger outer dimension than the end portions (82, 84) and on which two adjacent springs (88, 90) are braced, the at least one spring (88) being tightened in operation between one side of the support portion (86) and the piston (72), and the at least one other spring (90) being tightened between the other side of the support portion (86) and a housing portion (68).

8. The hydraulic system of claim 7, wherein said pressure reservoir further comprising at least two stops, which stops prevent the springs (88, 90) from being tightened into a block in operation.

9. The hydraulic system of claim 7 wherein at least one of the springs (88, 90) is a cup spring.

* * * * *